United States Patent [19]

Kjarsgaard

[11] 4,330,005

[45] May 18, 1982

[54] HOSE STORAGE APPARATUS

[76] Inventor: Torben Kjarsgaard, 9233 Scotmont Dr., Tujunga, Calif. 91042

[21] Appl. No.: 126,428

[22] Filed: Mar. 3, 1980

[51] Int. Cl.[3] ..... B65H 75/18

[52] U.S. Cl. ..... 137/355.28; 137/355.16; 242/86; 242/96; 242/129

[58] Field of Search ..... 137/355.16, 355.28; 248/75, 89; 242/86, 96, 129

[56] References Cited

U.S. PATENT DOCUMENTS

| | | | |
|---|---|---|---|
| Re. 30,727 | 9/1981 | Chong | 242/129 X |
| 1,532,177 | 4/1925 | Gist | 137/355.28 X |
| 2,300,243 | 10/1942 | Zierden | 242/86 |
| 2,334,141 | 11/1943 | Zierden | 137/355.28 |
| 2,871,057 | 1/1959 | Bernyk | 137/355.28 X |
| 3,776,262 | 12/1973 | Fritsch | 137/355.16 |

*Primary Examiner*—Gerald A. Michalsky
*Attorney, Agent, or Firm*—Boniard I. Brown

[57] ABSTRACT

A storage device for cooperation with an associated hose which may comprise an annular peripheral member having an axis, an upstanding truncated conical member disposed in generally coaxial relationship with the annular member and a wall extending intermediate the annular member and a lower end portion extremity of the truncated conical member. The wall may have a plurality of holes disposed therein. A handle may be formed in an upper end portion of the truncated conical member, which may define at least one aperture to define the handle.

9 Claims, 4 Drawing Figures

HOSE STORAGE APPARATUS

BACKGROUND OF THE INVENTION

The invention relates to storage devices and particularly to apparatus for the storage of hoses for carrying fluids. Although the invention has particular application for the storage of water hoses such as those commonly used for watering lawns and gardens it will be understood that it also has application for other applications where it is desired to store other hoses or any elongated flexible member such as wire.

It is a primary object of the invention to provide apparatus for the storage of hose which may be rapidly and inexpensively manufactured using mass production techniques.

Another object of the invention is to provide a structure which may be injection molded.

Still another object of the invention is to provide apparatus which will readily drain fluid from a hose stored within the apparatus.

Yet another object of the invention is to provide apparatus which will have an integral handle and which will not require the necessity of separate operations to attach one or more separate handles.

SUMMARY OF THE INVENTION

The foregoing objects and other objects and advantages which shall become apparent from the detailed description of the preferred embodiment are attained in a storage device for cooperation with an associated hose which comprises an annular peripheral member having an axis, an upstanding truncated conical member disposed in generally coaxial relationship with the annular member, and a wall extending intermediate the annular member and a lower end portion or first axial extremity of the truncated conical member. The wall has a plurality of holes disposed therein and a handle is formed in a second axial extremity or upper end portion of the truncated conical member, which may define at least one aperture to define the handle.

The apparatus may further have its handle defined by a second aperture in the second axial extremity. The first axial, or lower extremity of the truncated conical member may have a diameter greater than the second axial or upper extremity.

A notch may be disposed at the edge of the annular or band shaped member remote from the wall joining the band shaped member to the truncated conical member. The notch may be dimensioned and configured for holding one axial extremity of the associated hose. The first and second apertures of the handle may be elongated and have a strip shaped portion of the truncated conical member therebetween.

The height of the band shaped member and the truncated conical member are substantially the same. In another form of the invention the height of the band shaped member is less than the height of the truncated conical member. The band shaped member and the truncated conical member may be disposed in generally coaxial relationship and at least one axial extremity of each substantially abuts a common plane.

BRIEF DESCRIPTION OF THE ACCOMPANYING DRAWING

DESCRIPTION OF THE PREFERRED EMBODIMENT

Figure 1:
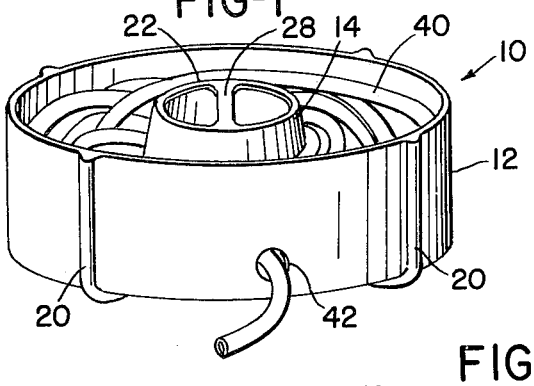
FIG. 1 is a perspective view of the apparatus in accordance with the invention.
Figure 2:
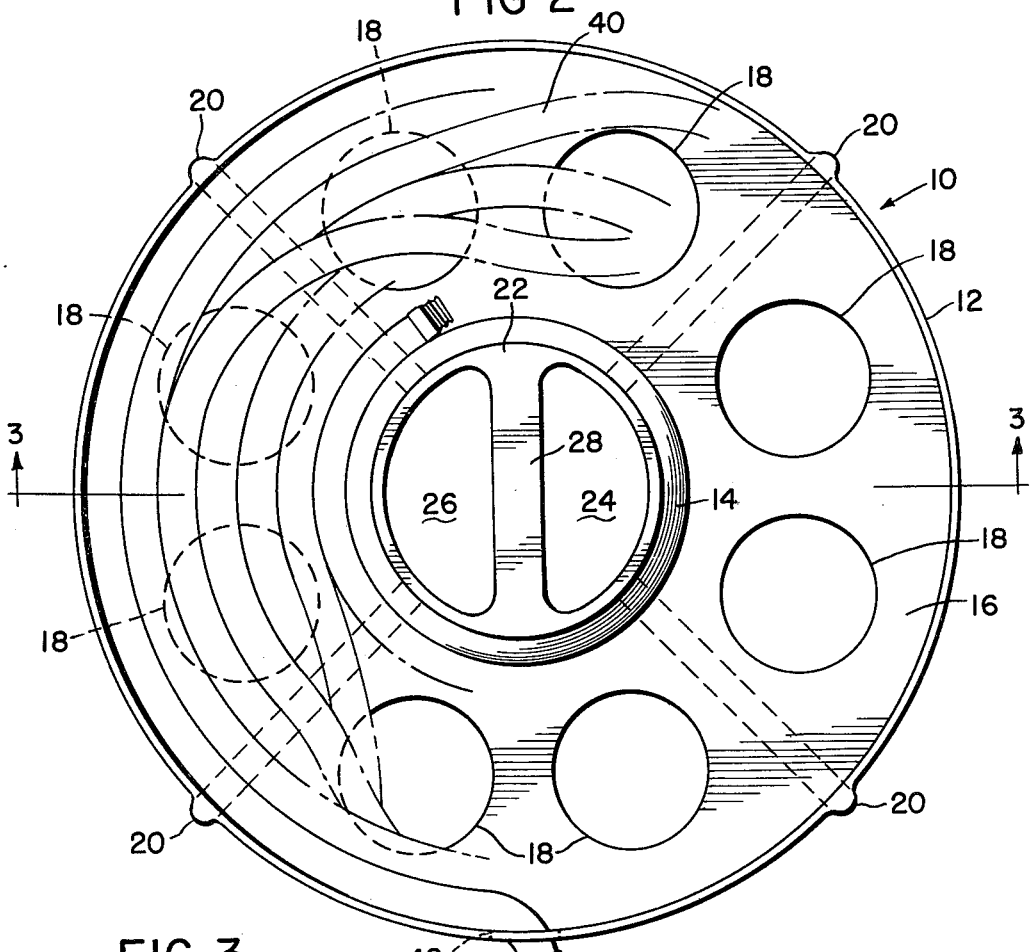
FIG. 2 is a plan view of the apparatus shown in FIG. 1.
Figure 3:
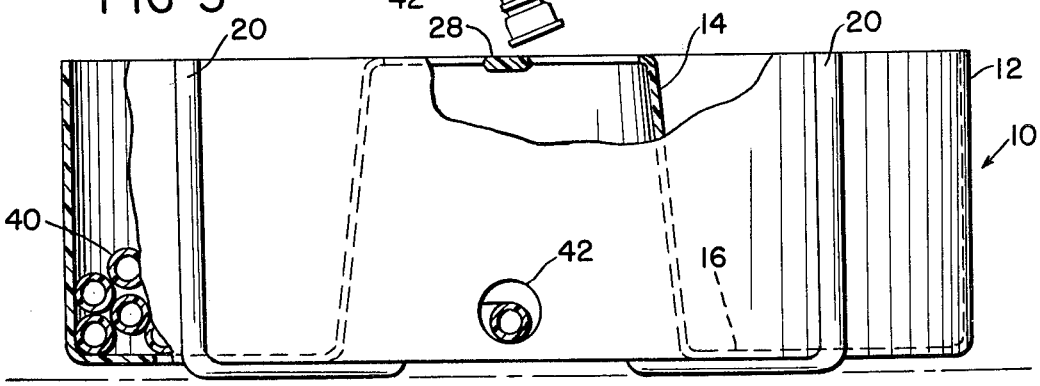
FIG. 3 is a sectional view taken through the line 3—3 of FIG. 2.

Referring now to FIGS. 1, 2, and 3 there is shown a storage apparatus 10 in accordance with the invention. The apparatus includes an annular or band shaped peripheral member 12 which is disposed in generally coaxial relationship with a truncated conical member 14. In this embodiment the axial extent of both the truncated conical member 14 and the band shaped member 12 are identical. Stated another way, a plane passing through either axial extremity of either member also passes through an axial extremity of the other member.

The truncated conical member 14 and the band shaped peripheral wall 12 are joined by a bottom wall 16 which is provided with large drain holes 18 which insure that no fluid is allowed to accumulate in the bottom of the storage apparatus 10. Extending along the outer surface of the band shaped peripheral wall 12 and along the bottom side of the wall 16 are ribs 20. The ribs 20 function as feet to further insure that any fluid in the container is drained off and also to further reinforce the band shaped member 12.

The apparatus in accordance with the invention preferrably has a second generally dome shaped axial extremity 22 of the truncated conical member 14. Elongated holes or apertures 24, 26 are disposed in the second axial extremity 22 and are separated by a strip shaped section 28 of the truncated conical member 14.

Figure 4:
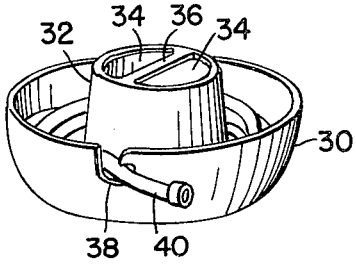
FIG. 4 is a perspective view of another embodiment of the invention.

Referring now to FIG. 4 there is shown another embodiment of the invention which includes a peripheral wall 30 which is also band shaped although it does have a contour which is more dished than in the embodiment illustrated in FIGS. 1–3. The truncated conical member 32 is positioned in generally coaxial relationship with the peripheral wall 30 and apertures or holes 34 are disposed in the truncated conical member 32 with a strip shaped handle 36 disposed intermediate the apertures 34. A notch 38 is provided in the peripheral wall 30 for accommodating the end of an associated hose 40 which extends out of the storage apparatus 10. The notch 38 has the function of retaining the loose end of the hose 40 which is stored in the container.

In the embodiment of FIG. 4 as well as the embodiment of FIGS. 1–3 an opening 42 ordinarily will be provided in the peripheral wall 30 for accommodating the other end of the hose 40. Ordinarily the end of the hose 40 which extends through the hole 42 will be the end which connects to the tap (not shown) with which the hose 40 is used. It will thus be seen that the storage apparatus in accordance with the invention may be left adjacent to a tap (not shown) where the hose 40 may be uncoiled from within the peripheral member and then replaced.

The apparatus in accordance with the invention ordinarily will be manufactured utilizing an injection molding technique. The design in accordance with the invention has the major advantage that it may be molded in a single step without the necessity for secondary manufacturing operations such as attaching handles and the like. Although the injection molding process is highly desired the apparatus may also be manufactured of sheet metal.

It will be understood that the holes 18 in addition to insuring the all accumulated fluids are drained off also reduce the weight of the apparatus to make it easier for a user of the apparatus to move it from one location to another. Injection molding has the further advantage in that it permits the variation of the color of the finished product by merely changing the molding compound which is used. Variations in color are, of course, desirable since the apparatus may be more desirable to many prospective purchasers if the color is compatible with the taste of the purchaser. It will be further seen that the smooth surfaces of an injection molded part will facilitate the easy removal of a hose 40 from within the container. The unit costs and particularly the unit variable costs will be understood to be extremely low for such injection molded parts. The provision of the hole 42 insures that it is not necessary to completely unwind the hose from within the container in order to connect to a tap.

The invention has been described with reference to its illustration preferred embodiment. Persons skilled in the art of constructing hose storage apparatus may, upon exposure to the teachings herein, conceive variations in the mechanical development of the components therein. Such variations are deemed to be encompassed by the disclosure, the invention being delimited only by the appended claims.

The inventor claims:

1. A storage device for cooperation with an associated hose which comprises:

a band shaped peripheral member having an axis;

an upstanding truncated conical member disposed in generally coaxial relationship with said band shaped member;

a wall extending intermediate a first axial extremity of said band shaped member and a first axial extremity of said truncated conical member, said wall having a plurality of holes disposed therein; and a handle formed in a second axial extremity of said truncated conical member, said handle comprising at least one aperture in a second axial extremity of said truncated conical member.

2. The apparatus as described in claim 1, wherein:

said handle further includes a second aperture in said second axial extremity.

3. The apparatus as described in claim 2 wherein:

said first axial extremity of said truncated conical member has a diameter greater than said second axial extremity.

4. The apparatus as described in claim 3, further including:

a notch disposed at the edge of said band shaped member remote from said wall joining said band shaped member to said truncated conical member, said notch being dimensioned and configured for holding one axial extremity of the associated hose.

5. The apparatus as described in claim 4, wherein:

said first and second apertures of said handle are elongated and have a strip shaped portion of said truncated conical member therebetween.

6. The apparatus as described in claim 1, wherein:

the height of said band shaped member and said truncated conical member are substantially the same.

7. The apparatus as described in claim 5, wherein:

the height of said band shaped member is less than the height of said truncated conical member.

8. The apparatus as described in claim 5 or 6, wherein:

said band shaped member and said truncated conical member are disposed in generally coaxial relationship and at least one axial extremity of each substantially abuts a common plane.

9. The apparatus as described in claim 8, wherein:

said apparatus is manufactured by an injection molding process.

* * * * *